US011749229B2

(12) United States Patent
Cha

(10) Patent No.: US 11,749,229 B2
(45) Date of Patent: Sep. 5, 2023

(54) DISPLAY DEVICE

(71) Applicant: SAMSUNG DISPLAY CO., LTD., Yongin-si (KR)

(72) Inventor: Ji-Won Cha, Asan-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/732,024

(22) Filed: Apr. 28, 2022

(65) Prior Publication Data

US 2023/0010243 A1 Jan. 12, 2023

(30) Foreign Application Priority Data

Jul. 9, 2021 (KR) ..... 10-2021-0090259

(51) Int. Cl.
*G09G 5/10* (2006.01)
*G09G 3/3233* (2016.01)

(52) U.S. Cl.
CPC ..... *G09G 5/10* (2013.01); *G09G 3/3233* (2013.01); *G09G 2320/045* (2013.01); *G09G 2320/0646* (2013.01)

(58) Field of Classification Search
CPC .. G09G 5/10; G09G 3/3233; G09G 2320/045; G09G 2320/0646
See application file for complete search history.

(56) References Cited

U.S. PATENT DOCUMENTS

| | | | | |
|---|---|---|---|---|
| 10,262,582 | B2 | 4/2019 | Han | |
| 2013/0235023 | A1 | 9/2013 | Chaji et al. | |
| 2014/0168039 | A1* | 6/2014 | Kim | G09G 3/3208 345/82 |
| 2014/0168191 | A1* | 6/2014 | Byeon | G09G 3/3233 345/82 |
| 2014/0168192 | A1* | 6/2014 | Jeong | G09G 3/3208 345/82 |
| 2016/0191952 | A1* | 6/2016 | Kim | G09G 3/3233 375/240.27 |
| 2017/0206819 | A1* | 7/2017 | Pyo | G09G 3/3225 |
| 2017/0213493 | A1* | 7/2017 | Han | G09G 3/3208 |
| 2020/0111455 | A1* | 4/2020 | Lee | G09G 3/2007 |
| 2020/0219432 | A1* | 7/2020 | Park | G09G 3/2003 |

FOREIGN PATENT DOCUMENTS

KR 10-2017-0088452 8/2017

* cited by examiner

*Primary Examiner* — Jeff Piziali
(74) *Attorney, Agent, or Firm* — F. Chau & Associates, LLC

(57) ABSTRACT

A display device includes a display panel including a plurality of pixels for displaying an image, and a panel controller configured to receive image signals and convert the image signals into correction image signals. The panel controller includes a first circuit to accumulate the correction image signals each frame period and generate degradation data based on the accumulated correction image signals, and a second circuit configured to determine reference data from the degradation data and generate the correction image signals by correcting the image signals to have a target luminance that is changed based on the reference data.

20 Claims, 12 Drawing Sheets

DISPLAY DEVICE

CROSS-REFERENCE TO RELATED APPLICATIONS

This U.S. non-provisional patent application claims priority under 35 U.S.C. § 119 to Korean Patent Application No. 10-2021-0090259, filed on Jul. 9, 2021, the disclosure of which is incorporated by reference herein.

1. TECHNICAL FIELD

The present disclosure herein relates to a display device, and more particularly, to a display device that compensates for display quality degradation due to deterioration of a display panel.

2. DISCUSSION OF RELATED ART

Various types of flat panel display devices are used to present an image. Examples of flat panel display devices include an organic light emitting display (OLED) device, a quantum dot display device, a liquid crystal display (LCD) device, and a plasma display device.

A flat panel display device may include a display panel for displaying an image and a driving circuit coupled to the display panel to provide a driving signal to the display panel. The display panel includes pixels that emit light. The OLED device includes an organic light emitting diode that generates light.

SUMMARY

An embodiment of the present disclosure provides a display device capable of compensating for deterioration in the quality of an image displayed on a display panel due to deterioration of the display panel.

An embodiment of the inventive concept provides a display device including: a display panel and a panel controller. The display panel includes a plurality of pixels to display an image. The panel controller is configured to receive image signals and convert the image signals into correction image signals. The panel controller includes: a cumulative calculation circuit configured to accumulate the correction image signals each period and generate degradation data based on the accumulated correction image signals; and a correction circuit configured to determine reference data from the degradation data and generate the correction image signals by correcting the image signals to have a target luminance that is changed based on the reference data.

In an embodiment, the target luminance may be a luminance of a pixel having the reference data among the pixels at a reference grayscale.

In an embodiment, the degradation data may include a plurality of degradation values indicating the degree of degradation of each of the pixels, wherein the reference data may have a smallest degradation value among the degradation values.

In an embodiment, the correction circuit may include: a reference value generation circuit configured to receive the degradation data from the cumulative calculation circuit and determine the reference data based on the degradation data; a correction value generation circuit configured to generate a correction value based on the reference data, the image signals, and the degradation data; and a correction signal generation circuit configured to generate the correction image signals by correcting the image signals based on the correction value.

In an embodiment, the correction value generation circuit may include: a memory device including a lookup table; and a extraction circuit configured to read the reference correction value stored in the lookup table based on the image signals and the degradation data, and convert the reference correction value to correspond to the target luminance to generate the correction value.

In an embodiment, the reference correction value may be a value set to correct the image signals with a preset reference luminance, wherein the correction value may be a value set to correct the image signals to have the target luminance.

In an embodiment, the extraction circuit may include: a first sub extraction circuit configured to read the reference correction value stored in the lookup table based on the image signals and the degradation data; and an second sub extraction circuit configured to receive the reference correction value from the first sub extraction circuit, receive the reference data from the reference value generation circuit, and convert the reference correction value to correspond to the target luminance to generate the correction value.

In an embodiment, the correction signal generation circuit may receive the correction value from the second sub extraction circuit and correct the image signals based on the correction value to generate the correction image signals.

In an embodiment, the correction value generation circuit may include: a memory device including a plurality of lookup tables; and a extraction circuit configured to select one of the plurality of lookup tables based on the reference data and extract a correction value stored in the selected lookup table based on the image signals and the degradation data.

In an embodiment, the lookup tables may include a first lookup table and a second lookup table, wherein the correction value may include a first correction value and a second correction value, wherein the extraction circuit, when the degradation value of the reference data is less than or equal to a preset first degradation value, may extract the first correction value from the first lookup table, and when the degradation value of the reference data is greater than the first degradation value, may extract the second correction value from the second lookup table.

In an embodiment, the first lookup table may be a lookup table in which the first correction value set based on a preset first reference luminance is stored, wherein the second lookup table may be a lookup table in which the second correction value set based on a preset second reference luminance is stored, wherein the second reference luminance may correspond to the luminance of the pixel having the first degradation value among the pixels in the reference grayscale, wherein the first reference luminance may be greater than the second reference luminance.

In an embodiment, the correction value may further include a third correction value, wherein the lookup tables may further include a third lookup table, wherein the extraction circuit, when the degradation value of the reference data is greater than the first degradation value and less than or equal to a preset second degradation value, may extract the second correction value from the second lookup table, and when the degradation value of the reference data is greater than the second degradation value, may extract the third correction value from the third lookup table, wherein the second degradation value may be greater than the first degradation value.

In an embodiment, the third lookup table may be a lookup table in which the third correction value set based on a preset third reference luminance is stored, wherein the third reference luminance may correspond to the luminance of the pixel having the second degradation value among the pixels in the reference grayscale, wherein the second reference luminance may be greater than the third reference luminance.

In an embodiment, the panel controller may further include a data generation circuit that generates image data based on the correction image signals.

In an embodiment, the panel controller may further include a temperature sensor that measures the temperature of the display panel, wherein the cumulative calculation circuit may receive a temperature signal including information on the temperature from the temperature sensor, and generate the degradation data based on the accumulated correction image signals and the temperature signal.

In an embodiment of the inventive concept, a display device includes: a display panel including a plurality of pixels displaying an image; and a panel controller configured to receive image signals and convert the image signals into correction image signals. The panel controller includes: a cumulative calculation circuit configured to accumulate the correction image signals each frame period and generate degradation data including a plurality of degradation values indicating the degree of degradation of each of the pixels based on the accumulated correction image signals; and a correction circuit configured to extract the reference data from the degradation data. If the degradation value included in the reference data is less than or equal to the preset standard degradation value, the correction circuit is configured to generate the correction image signals by correcting the image signals to have a preset first reference luminance. If the degradation value is greater than the standard degradation value, the correction circuit is configured to generate the correction image signals by correcting the image signals to have a preset second reference luminance. The first reference luminance is greater than the second reference luminance.

In an embodiment, the reference data may have a smallest degradation value among the degradation values.

In an embodiment, the correction circuit may include: a reference value generation circuit configured to receive the degradation data from the cumulative calculation circuit and determine the reference data based on the degradation data; a correction value generation circuit configured to generate a correction value based on the reference data, the image signals, and the degradation data; and a correction signal generation circuit configured to generate the correction image signals by correcting the image signals based on the correction value.

In an embodiment, the correction value generation circuit may include: a memory device including a plurality of lookup tables; and an extraction circuit configured to select one of the plurality of lookup tables based on the reference data and extract a correction value stored in the selected lookup table based on the image signals and the degradation data.

In an embodiment, the lookup tables may include a first lookup table and a second lookup table, wherein the correction value may include a first correction value and a second correction value. When the degradation value of the reference data is less than or equal to the reference degradation value, the extraction circuit may extract the first correction value from the first lookup table. When the degradation value of the reference data is greater than the reference degradation value, the extraction circuit may extract the second correction value from the second lookup table. The first lookup table may be a lookup table in which the first correction value set based on the first reference luminance is stored, wherein the second lookup table may be a lookup table in which the second correction value set based on the second reference luminance is stored.

BRIEF DESCRIPTION OF THE FIGURES

The accompanying drawings are included to provide a further understanding of the inventive concept. The drawings illustrate embodiments of the inventive concept and, together with the description, serve to explain principles of the inventive concept. In the drawings.

DETAILED DESCRIPTION

Figure 1:
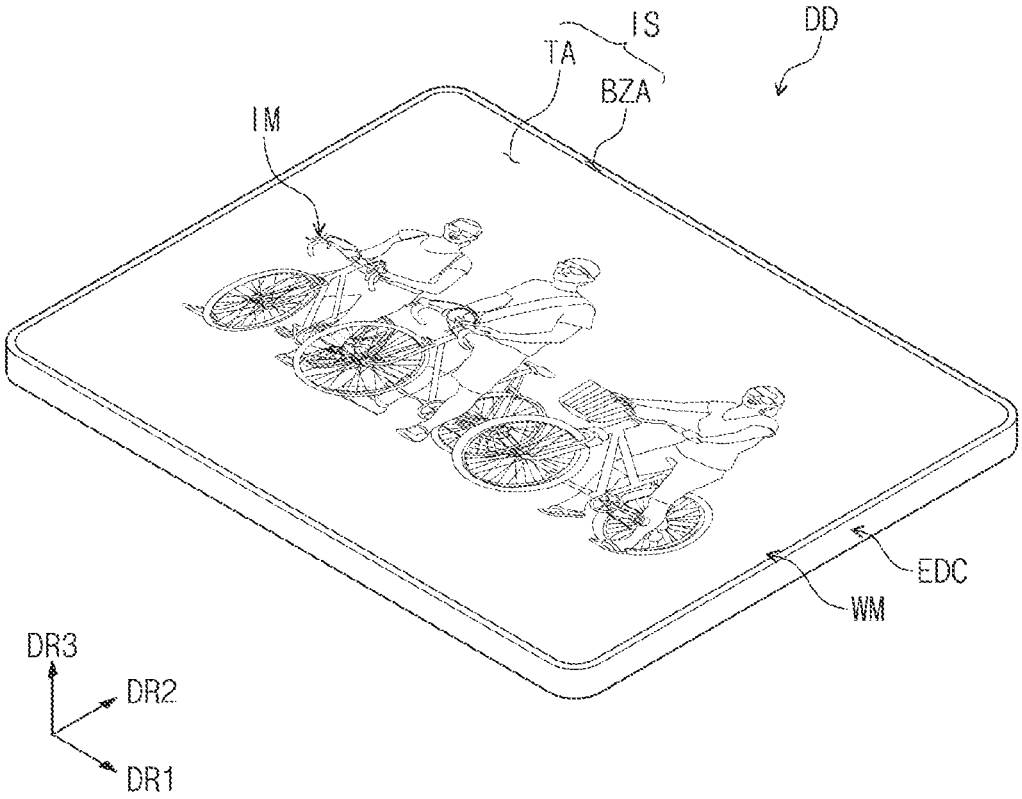
FIG. 1 is a perspective view of a display device according to an embodiment of the inventive concept.

In this specification, when an element (or region, layer, part, etc.) is referred to as being "on", "connected to", or "coupled to" another element, it means that it may be directly placed on/connected to/coupled to other components, or a third component may be arranged between them.

Like reference numerals refer to like elements through the specification. Additionally, in the drawings, the thicknesses, proportions, and dimensions of components may be exaggerated for effective description. "And/or" includes all of one or more combinations defined by related components.

It will be understood that the terms "first" and "second" are used herein to describe various components but these components should not be limited by these terms. The above terms are used only to distinguish one component from another. For example, a first component may be referred to as a second component and vice versa without departing from the scope of the inventive concept. The terms of a singular form may include plural forms unless otherwise specified.

In addition, terms such as "below", "the lower side", "on", and "the upper side" are used to describe a relationship of components shown in the drawing. The terms are described as a relative concept based on a direction shown in the drawing.

Hereinafter, embodiments of the inventive concept will be described with reference to the drawings.

Figure 2:
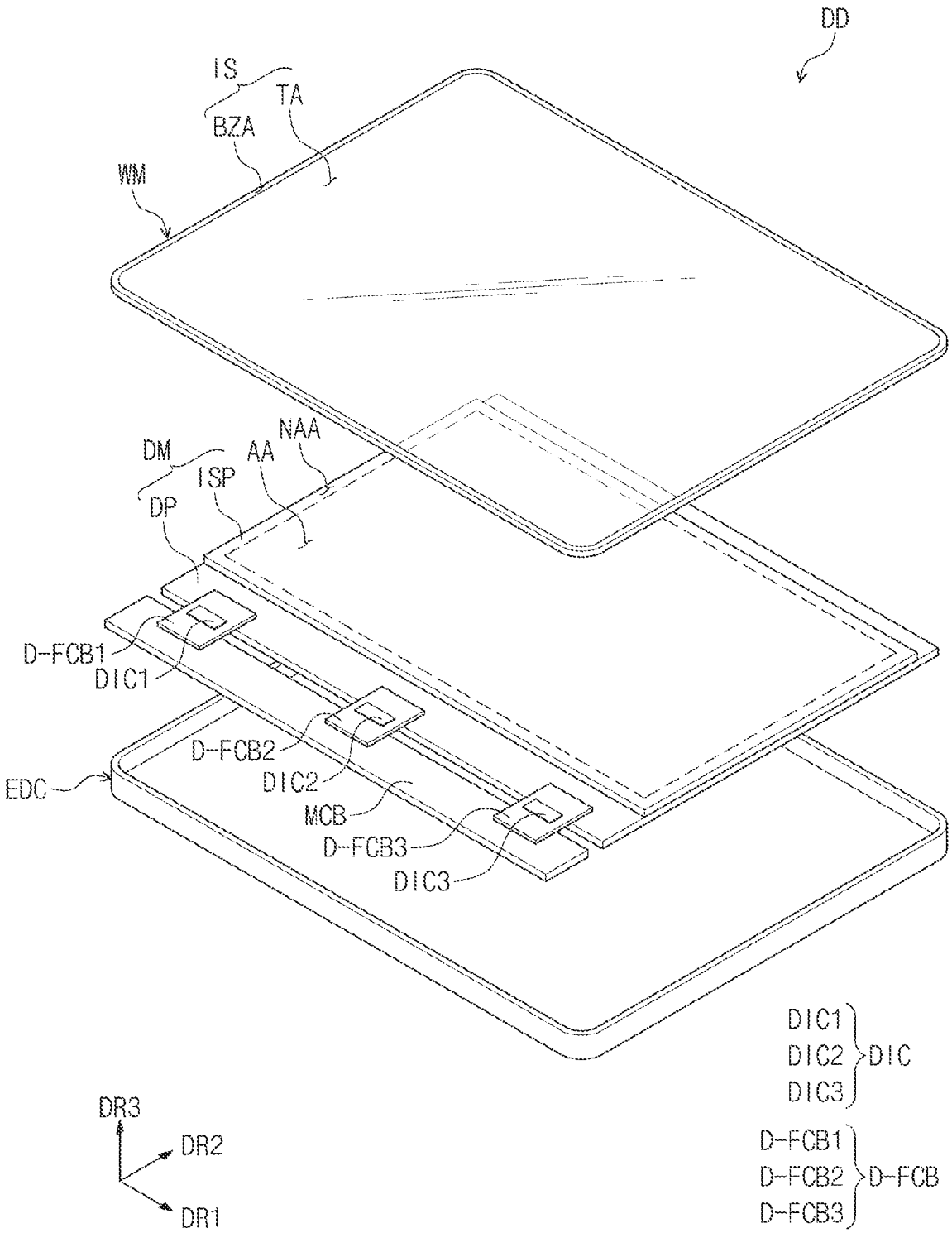
FIG. 2 is an exploded perspective view of the display device shown in FIG. 1.

FIG. 1 is a perspective view of a display device according to an embodiment of the inventive concept, and FIG. 2 is an exploded perspective view of the display device shown in FIG. 1.

Referring to FIGS. 1 and 2, the display device DD may be a device that is activated according to an electrical signal. The display device DD according to the inventive concept may be a small or medium-sized display device such as a mobile phone, a tablet, a notebook computer, a car navigation system, and a gaming machine in addition to large display devices such as TVs and monitors. These are only presented by way of example, and may be employed in other electronic devices without departing from the inventive concept.

The display device DD has a rectangular shape having a long side in a first direction DR1 and a short side in a second direction DR2 intersecting the first direction DR1. However, the shape of the display device DD is not limited thereto, and various shapes of the display device DD may be provided. The display device DD may display the image IM in the third direction DR3 on the display surface IS parallel to each of the first direction DR1 and the second direction DR2. The display surface IS on which the image IM is displayed may correspond to the front surface of the display device DD.

In this embodiment, the front (or upper surface) and the rear surface (or lower surface) of each member are defined based on the direction in which the image IM is displayed. The front and rear surfaces are opposing to each other in the third direction DR3, and a normal direction of each of the front and rear surfaces may be parallel to the third direction DR3.

The separation distance between the front and rear surfaces in the third direction DR3 may correspond to the thickness in the third direction DR3 of the display device DD. Moreover, the directions indicated by the first to third directions DR1, DR2, and DR3 are relative concepts and may be converted to other directions.

The display device DD may detect an external input applied from the outside. The external input may include various types of inputs provided from the outside of the display device DD. The display device DD according to an embodiment of the inventive concept may sense an external input of a user applied from the outside. The user's external input may be any one or a combination of various types of external inputs, such as a part of the user's body, light, heat, gaze, or pressure. In addition, the display device DD may detect a user's external input applied to the side or rear surface of the display device DD according to the structure of the display device DD, and is not limited to any one embodiment. As an example of the inventive concept, the external input may include an input by an input device (e.g., a stylus pen, an active pen, a touch pen, an electronic pen, an e-pen, etc.).

The display surface IS of the display device DD may be divided into a transmissive area TA and a bezel area BZA. The transmissive area TA may be an area in which the image IM is displayed. The user recognizes the image IM through the transmissive area TA. In this embodiment, the transmissive area TA is illustrated in a rectangular shape with rounded vertices. However, this is illustrated by way of example, and the transmissive area TA may have various shapes, and is not limited to any one embodiment.

The bezel area BZA is adjacent to the transmissive area TA. The bezel area BZA may have a predetermined color. The bezel area BZA may surround the transmissive area TA. Accordingly, the shape of the transmissive area TA may be substantially defined by the bezel area BZA. However, this is illustrated as an example, and the bezel area BZA may be disposed adjacent to only one side of the transmissive area TA, or may be omitted. The display device DD according to an embodiment of the inventive concept may include various embodiments, and is not limited to any one embodiment.

As shown in FIG. 2, the display device DD may include a display module DM and a window WM disposed on the display module DM. The display module DM may include a display panel DP and an input sensing layer ISP.

The display panel DP according to an embodiment of the inventive concept may be a light emitting display panel. For example, the display panel DP may be an organic light emitting display panel, an inorganic light emitting display panel, or a quantum dot light emitting display panel. The light emitting layer of the organic light emitting display panel may include an organic light emitting material. The light emitting layer of the inorganic light emitting display panel may include an inorganic light emitting material. The light emitting layer of the quantum dot light emitting display panel may include a quantum dot and a quantum rod. Hereinafter, the display panel DP in this embodiment will be described as an organic light emitting display panel.

The display panel DP outputs an image IM, and the output image IM may be displayed through the display surface IS.

An input sensing layer ISP may be disposed on the display panel DP to detect an external input. An input sensing layer ISP will be described later with reference to FIG. 4.

The window WM may be made of a transparent material capable of emitting an image. For example, the window member WM may be made of glass, sapphire, plastic, or the like. The window WM is illustrated as a single layer, but is not limited thereto and may include a plurality of layers.

Meanwhile, although not shown in the drawing, the bezel area BZA of the display device DD described above may be substantially provided as an area in which a material including a predetermined color is printed on one area of the window WM. As an example of the inventive concept, the window WM may include a light blocking pattern for defining the bezel area BZA. The light blocking pattern may be formed as a colored organic film, for example, by a coating method. For example, the light blocking pattern may be present on the perimeter of the window WM to define the bezel area BZA.

The window WM may be coupled to the display module DM through an adhesive film. As an example of the inventive concept, the adhesive film may include an optically clear adhesive (OCA) film. However, the adhesive film is not limited thereto, and may include a conventional adhesive or pressure-sensitive adhesive. For example, the adhesive film may include an optically clear resin (OCR) or a pressure sensitive adhesive (PSA) film.

An antireflection layer may be further disposed between the window WM and the display device DD. The antireflection layer reduces the reflectance of external light incident from the upper side of the window WM. The antireflection layer according to an embodiment of the inventive concept may include a retarder and a polarizer. The retarder may be a film type or a liquid crystal coating type, and may include a half wavelength ($\lambda/2$) retarder and/or a quarter wavelength ($\lambda/4$) retarder. The polarizer may also be a film type or a liquid crystal coating type. The film type may include a stretchable synthetic resin film, and the liquid crystal coating type may include liquid crystals arranged in a predetermined arrangement. The retarder and the polarizer may be implemented as one polarizing film.

As an example of the inventive concept, the antireflection layer may include color filters. An arrangement of color filters may be determined in consideration of colors of light generated by a plurality of pixels PX (refer to FIG. 3) included in the display panel DP. The antireflection layer may further include a light blocking pattern.

The display module DM may display an image according to an electrical signal and transmit/receive information based on an external input. The display module DM may be include an active area AA and a non-active area NAA. The active area AA may be defined as an area emitting an image provided by the display module DM. Also, the active area AA may be defined as an area in which the input sensing layer ISP detects an external input applied from the outside.

The non-active area NAA is adjacent to the active area AA. For example, the non-active area NAA may enclose the active area AA. However, this is illustrated by way of example, and the non-active area NAA may be defined in various shapes, and is not limited to any one embodiment. According to an embodiment, the active area AA of the display module DM may correspond to at least a portion of the transmissive area TA.

The display module DM may further include a main circuit board MCB, a plurality of flexible circuit films D-FCB, and a plurality of driving chips DIC. The main circuit board MCB may be electrically connected to the display panel DP by being connected to the flexible circuit films D-FCB. The flexible circuit films D-FCB are connected to the display panel DP to electrically connect the display panel DP and the main circuit board MCB. The main circuit board MCB may include a plurality of driving elements. The plurality of driving elements may include a circuit for driving the display panel DP. Driving chips DIC may be mounted on the flexible circuit films D-FCB.

As an example of the inventive concept, the flexible circuit films D-FCB may include a first flexible circuit film D-FCB1, a second flexible circuit film D-FCB2, and a third flexible circuit film D-FCB3. The driving chips DIC may include a first driving chip DIC1, a second driving chip DIC2, and a third driving chip DIC3. The first to third flexible circuit films D-FCB1, D-FCB2, and D-FCB3 are disposed to be spaced apart from each other in the first direction DR1, and are connected to the display panel DP so that the display panel DP and the main circuit board MCB may be electrically connected. The first driving chip DIC1 may be mounted on the first flexible circuit film D-FCB1. The second driving chip DIC2 may be mounted on the second flexible circuit film D-FCB2. The third driving chip DIC3 may be mounted on the third flexible circuit film D-FCB3. However, embodiments of the inventive concept are not limited thereto. For example, the display panel DP may be electrically connected to the main circuit board MCB through one flexible circuit film, and only one driving chip may be mounted on the one flexible circuit film. In addition, the display panel DP may be electrically connected to the main circuit board MCB through four or more flexible circuit films, and driving chips may be respectively mounted on the flexible circuit films.

FIG. 2 illustrates a structure in which the first to third driving chips DIC1, DIC2, and DIC3 are mounted on the first to third flexible circuit films D-FCB1, D-FCB2, and D-FCB3, respectively, but the inventive concept is not limited thereto. For example, the first to third driving chips DIC1, DIC2, and DIC3 may be directly mounted on the display panel DP. In this embodiment, the portion on which the first to third driving chips DIC1, DIC2, and DIC3 are mounted on the display panel DP may be bent and disposed on the rear surface of the display module DM. Also, the first to third driving chips DIC1, DIC2, and DIC3 may be directly mounted on the main circuit board MCB.

The input sensing layer ISP may be electrically connected to the main circuit board MCB through the flexible circuit films D-FCB. However, embodiments of the inventive concept are not limited thereto. That is, the display module DM may additionally include a separate flexible circuit film for electrically connecting the input sensing layer ISP to the main circuit board MCB.

The display device DD further includes an external case EDC for accommodating the display module DM. The external case EDC may be combined with the window WM to define the appearance of the display device DD. The external case EDC may absorb the impact applied from the outside and may protect the components contained in the external case EDC by preventing foreign matter/moisture from penetrating into the display module DM. Meanwhile, as an example of the inventive concept, the external case EDC may be provided in a form in which a plurality of accommodating members are combined.

The display device DD according to an embodiment may further include an electronic module (or device) including various functional modules for operating the display module DM, a power supply module (or device) for supplying power required for the overall operation of the display device DD, and a bracket that is combined with the external case EDC to divide the inner space of the display device DD.

Figure 3:
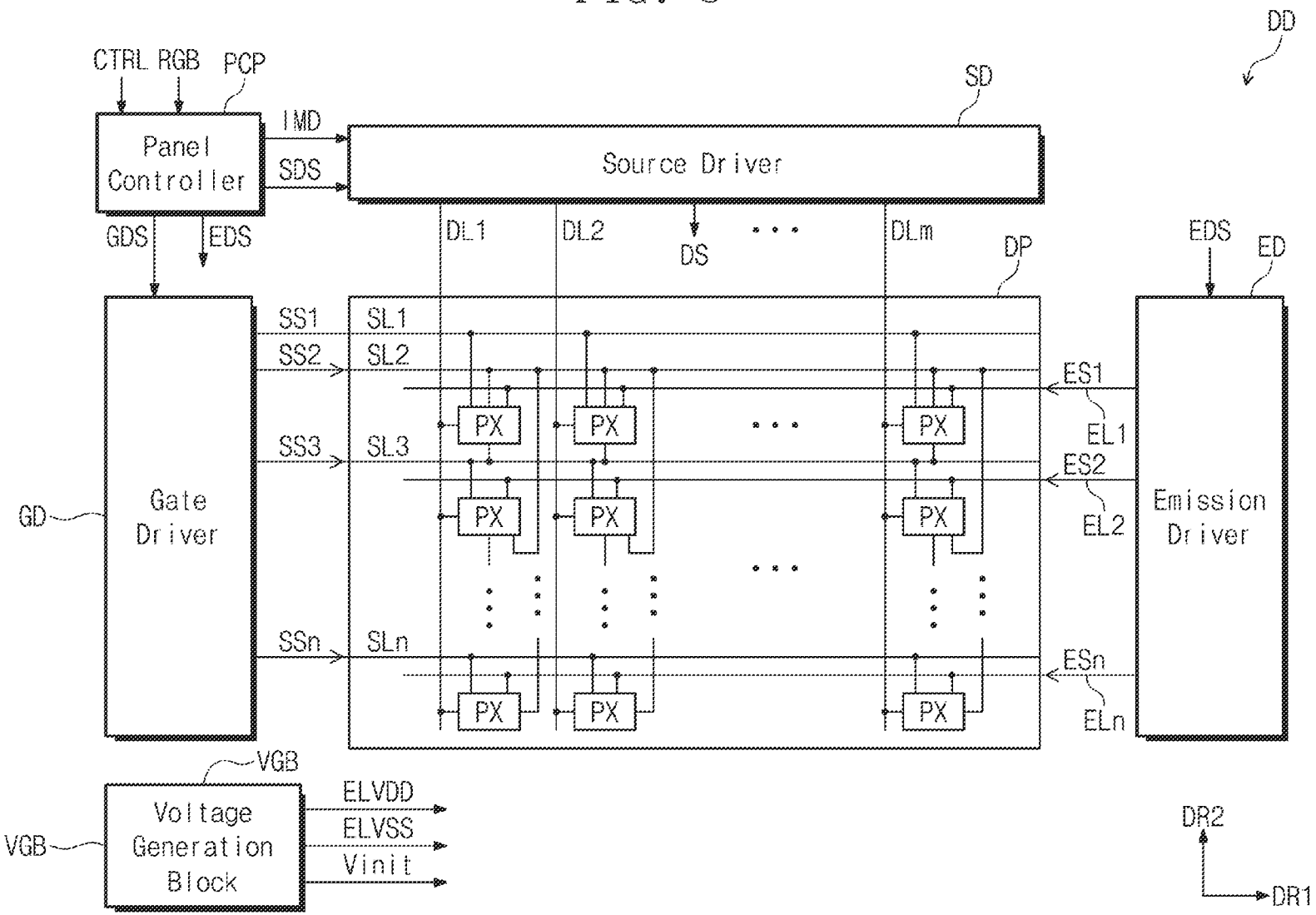
FIG. 3 is a block diagram of a display device according to an embodiment of the inventive concept.

FIG. 3 is a block diagram of a display device according to an embodiment of the inventive concept.

Referring to FIG. 3, as an example of the inventive concept, the display device DD includes a display panel DP, a panel controller PCP (e.g., a control circuit), a source driver SD (e.g., a driver circuit), a gate driver GD (e.g., a driver circuit), a voltage generating block VGB (e.g., a voltage generator or voltage generation circuit), and a light emitting driver ED (e.g., a driver circuit).

The panel controller PCP receives image signals RGB and an external control signal CTRL from the outside. The panel controller PCP converts the image signals RGB into correction image signals CRGB (refer to FIG. 5). The configuration and operation of the panel controller PCP that converts image signals RGB into correction image signals CRGB will be described later with reference to FIGS. 5 to 13. The panel controller PCP generates image data IMD by converting the data format of the correction image signals CRGB to meet the interface specification with the source driver SD. The panel controller PCP generates a source driving signal SDS, a gate driving signal GDS, and an emission control signal EDS based on the external control signal CTRL. The external control signal CTRL may include a vertical synchronization signal, a horizontal synchronization signal, and a main clock signal.

The panel controller PCP transmits the image data IMD and the source driving signal SDS to the source driver SD. The source driving signal SDS may include a horizontal start signal for starting the operation of the source driver SD. The source driver SD generates a data signal DS based on the image data IMD in response to the source driving signal SDS. The source driver SD outputs the data signal DS to a plurality of data lines DL1 to DLm, which will be described later. The data signal DS may be an analog voltage corresponding to a grayscale value of the image data IMD.

The panel controller PCP transmits the gate driving signal GDS to the gate driver GD. The gate driving signal GDS may include a vertical start signal for starting the operation of the gate driver GD, a scan clock signal for determining output timing of the scan signals SS1 to SSn, and the like. The gate driver GD generates scan signals SS1 to SSn based on the gate driving signal GDS. The gate driver GD outputs the scan signals SS1 to SSn to a plurality of scan lines SL1 to SLn to be described later.

The panel controller PCP transmits an emission control signal EDS to the light emitting driver ED. The light emitting driver ED outputs the emission control signals ES1 to ESn to the plurality of emission lines EL1 to ELn in response to the emission control signal EDS.

The voltage generating block VGB generates voltages necessary for the operation of the display panel DP. As an example of the inventive concept, the voltage generating block VGB generates a first driving voltage ELVDD, a second driving voltage ELVSS, and an initialization voltage Vinit. As an example of the inventive concept, the voltage generating block VGB may operate under the control of the panel controller PCP. As an example, the voltage level of the first driving voltage ELVDD is greater than the voltage level of the second driving voltage ELVSS. As an example of the inventive concept, the voltage level of the first driving voltage ELVDD may be about 20V to about 30V. In an embodiment, the voltage level of the initialization voltage Vinit is less than the voltage level of the second driving voltage ELVSS. As an example of the inventive concept, the voltage level of the initialization voltage Vinit may be about 1V to about 9V.

As an example of the inventive concept, the display panel DP includes a plurality of scan lines SL1 to SLn, a plurality of data lines DL1 to DLm, a plurality of emission lines EL1 to ELn, and a plurality of pixels PX.

The scan lines SL1 to SLn extend from the gate driver GD in the first direction DR1 and are arranged to be spaced apart from each other in the second direction DR2. The data lines DL1 to DLm extend in a direction opposite to the second direction DR2 from the source driver SD and are arranged to be spaced apart from each other in the first direction DR1.

Each of the pixels PX is electrically connected to three corresponding scan lines among the scan lines SL1 to SLn. Also, each of the pixels PX is electrically connected to a corresponding one of the emission lines EL1 to ELn and a corresponding one of the data lines DL1 to DLm, respectively. For example, as shown in FIG. 3, the pixels in the first row may be connected to the first to third scan lines SL1, SL2, and SL3, the first emission line EL1, and the first data line DL1. However, as an example of the inventive concept, according to the configuration of the driving circuit of the pixels PX, a connection relationship between the pixels PX and the scan lines SL1 to SLn, and between the data lines DL1 to DLm and the emission lines EL1 to ELn may be changed.

Each of the pixels PX may include a light emitting diode that generates color light. For example, the pixels PX may include red pixels generating red color light, green pixels generating green color light, and blue pixels generating blue color light. The light emitting diode of the red pixel, the light emitting diode of the green pixel, and the light emitting diode of the blue pixel may include light emitting layers of different materials. As an example of the inventive concept, each of the pixels PX may include white pixels generating white color light. In this embodiment, the display device DD may further include color filters. The display device DD may display the image IM based on the light emitted by the white color light passing through the color filters.

Each of the pixels PX may include a pixel circuit controlling light emission of the light emitting diode. The pixel circuit may include a plurality of transistors and a capacitor. Each of the pixels PX receives the first driving voltage ELVDD, the second driving voltage ELVSS, and the initialization voltage Vinit.

Figure 4:
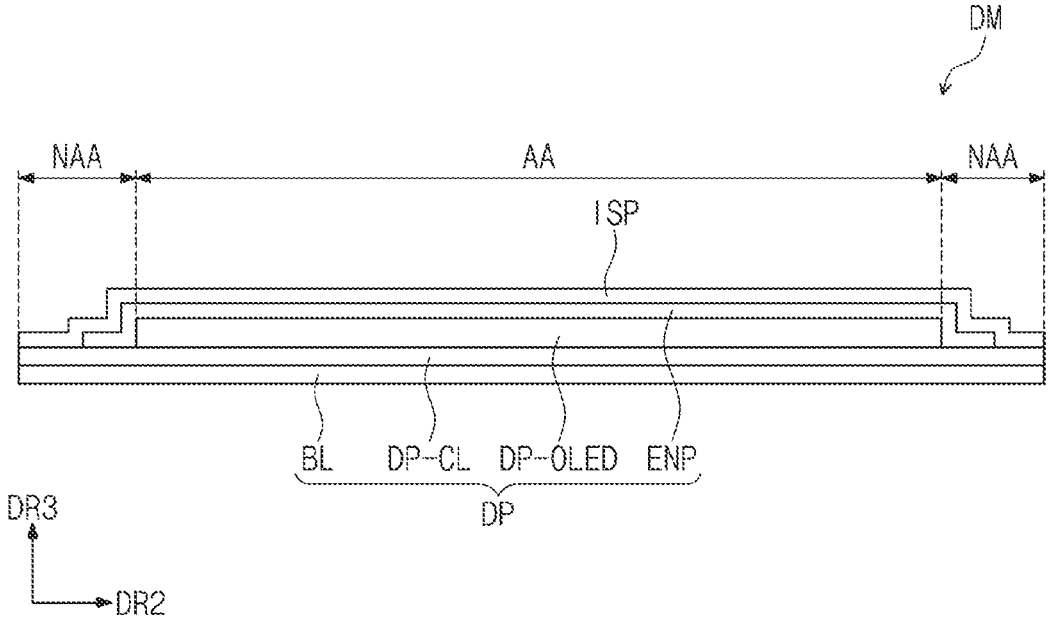
FIG. 4 is a cross-sectional view of the display module shown in FIG. 2.

FIG. 4 is a cross-sectional view of the display module shown in FIG. 2.

Referring to FIG. 4, the display module DM includes a display panel DP and an input sensing layer ISP. The input sensing layer ISP may be located in both the non-active area NAA and the active area AA. The display panel DP includes a base layer BL, a circuit element layer DP-CL disposed on the base layer BL, a display element layer DP-OLED, and an encapsulating layer ENP. The encapsulating layer ENP may surround the display element layer DP-OLED. Although not shown separately, the display panel DP may further include functional layers such as an antireflection layer and a refractive index control layer.

The base layer BL may include at least one synthetic resin layer. The base layer BL may include a glass material layer, a metal material layer, or an organic/inorganic composite material layer in addition to the synthetic resin layer. As an example of the inventive concept, the base layer BL may be a flexible layer. The active area AA and the non-active area NAA described with reference to FIG. 2 may be equally defined in the base layer BL.

The circuit element layer DP-CL is disposed on the base layer BL. The circuit element layer DP-CL may include at least one intermediate insulating layer and a circuit element. The intermediate insulating layer includes at least one intermediate inorganic layer and at least one intermediate organic layer. For example, the circuit element may include signal lines and a pixel circuit.

The display element layer DP-OLED is disposed on the circuit element layer DP-CL. The display element layer DP-OLED includes a plurality of pixels. Each pixel may include a light emitting diode. As an example of the inventive concept, each pixel may include organic light emitting diodes. The display element layer DP-OLED may further include an organic film such as a pixel defining film.

The encapsulation layer ENP seals the display element layer DP-OLED. The encapsulation layer ENP includes at least one inorganic layer. The encapsulation layer ENP may further include at least one organic layer. The inorganic layer may protect the display element layer DP-OLED from moisture/oxygen, and the organic layer may protect the display element layer DP-OLED from foreign substances such as dust particles. The inorganic layer may include a silicon nitride layer, a silicon oxynitride layer and a silicon oxide layer, a titanium oxide layer, or an aluminum oxide layer. The organic layer may include an acrylic organic layer, but is not limited thereto.

The input sensing layer ISP may be formed on the display panel DP by a continuous process. The input sensing layer ISP may have a multi-layered structure. The input sensing layer ISP may include a single or multiple insulating layers. According to one embodiment of the inventive concept, when the input sensing layer ISP is disposed directly on the display panel DP by a continuous process, the input sensing layer ISP is disposed directly on the encapsulation layer ENP, and no adhesive film is disposed between the input sensing layer ISP and the display panel DP. However, as another example, an adhesive film may be disposed between the input sensing layer ISP and the display panel DP. In this embodiment, the input sensing layer ISP is not manufactured by a continuous process with the display panel DP, and after being manufactured through a process separate from the display panel DP, the input sensing layer ISP may be fixed to the upper surface of the display panel DP by an adhesive film.

As another example of the inventive concept, the display panel DP may further include an encapsulating substrate. The encapsulating substrate may be disposed on the display element layer DP-OLED to face the base layer BL. The encapsulating substrate may include a plastic substrate, a glass substrate, a metal substrate, or an organic/inorganic composite substrate. A sealant may be disposed between the encapsulating substrate and the base layer BL, and the encapsulating substrate and the base layer BL may be combined with each other by the sealant. The sealant may include an organic adhesive or a ceramic adhesive material, such as frit. The display element layer DP-OLED may be sealed by a sealant and the encapsulating substrate.

When the input sensing layer ISP is disposed directly on the display panel DP by a continuous process, an input sensing layer ISP may be disposed directly on the encapsulating substrate. However, as another example, when an adhesive film is disposed between the input sensing layer ISP and the display panel DP, the input sensing layer ISP may be fixed to the upper surface of the encapsulating substrate by the adhesive film.

Figure 5:
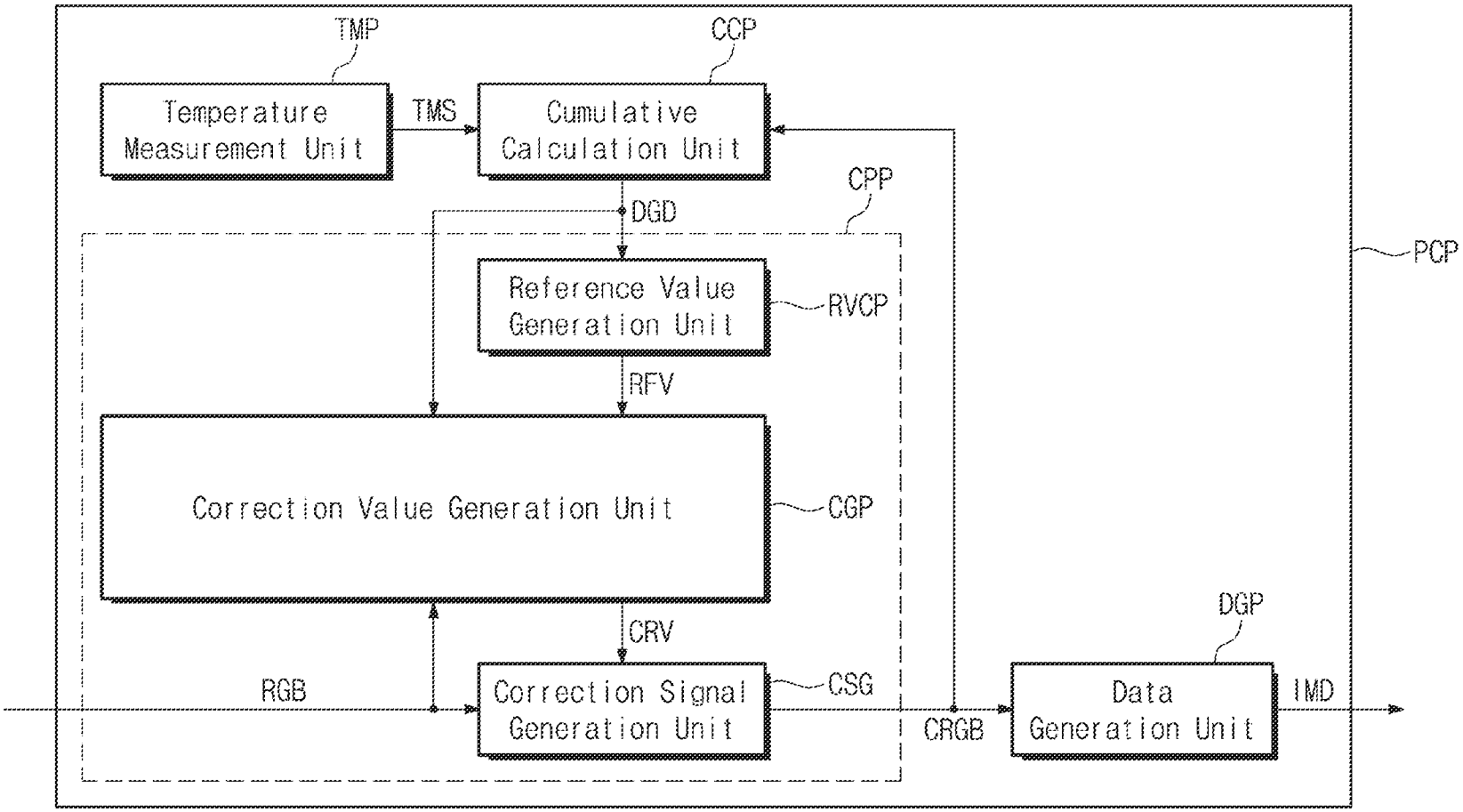
FIG. 5 is a block diagram illustrating the structure of a panel controller according to an embodiment of the inventive concept.

FIG. 5 is a block diagram illustrating the structure of the panel controller of FIG. 3 according to an embodiment of the inventive concept.

Referring to FIGS. 3 and 5, the panel controller PCP includes a cumulative calculation unit CCP (e.g., a circuit), a correction unit CPP (e.g., a circuit), and a data generation unit DGP (e.g., a circuit). As an example of the inventive concept, the light emitting diode included in each of the pixels PX may deteriorate during the process of emitting light to display the image IM (see FIG. 1) on the display panel DP. Accordingly, even when the data signal DS having the same grayscale is provided, the luminance of each of the pixels PX may be different according to the degree of deterioration of each of the pixels PX.

As an example of the inventive concept, the cumulative calculation unit CCP receives correction image signals CRGB output from the correction unit CPP every frame (or frame period). In an embodiment, the cumulative calculation unit CCP accumulates the correction image signals CRGB received every frame, and generates degradation data DGD based on the previously accumulated correction image signals. For example, the cumulative calculation unit CCP could receive a first correction image signal for a first pixel for a first frame period, receive a second correction image signal for the first pixel for a second frame period, and average the first and second correction images to generate one of the accumulated correction image signals. As an example of the inventive concept, the degradation data DGD includes a plurality of degradation values indicating the degree of degradation of each of the pixels PX as the display panel DP is driven. As an example of the inventive concept, the degradation value of each pixel PX is determined by at least one of a driving frequency of display panel DP, a length of the light emitting period of each pixel PX in one frame, the luminance of each pixel PX, and the total emission time of each pixel PX. As an example of the inventive concept, even if the data signal DS (see FIG. 3) having the same gray level is provided, the luminance of a pixel having a relatively large degradation value is smaller than the luminance of a pixel having a relatively small degradation value.

The correction unit CPP receives image signals RGB from the outside, and receives degradation data DGD from the cumulative calculation unit CCP. The correction unit CPP extracts reference data RFV from the degradation data DGD. The correction unit CPP generates correction image signals CRGB by correcting the image signals RGB to have a target luminance that is changed based on the reference data RFV. As an example of the inventive concept, the target luminance may be the luminance of the pixel having the reference data RFV among the pixels PX in the reference grayscale. As an example of the inventive concept, the reference grayscale may be a grayscale to display full white. However, the inventive concept is not limited thereto, and the reference grayscale may vary depending on the type of image IM displayed on the display panel DP. When the data signal DS having the reference grayscale is applied to the pixels PX, the correction unit CPP may correct the image signals RGB so that the luminance of the remaining pixels excluding the pixel having the reference data RFV among the pixels PX is equal to the target luminance. Through this, it is possible to prevent display quality degradation such as image sticking due to the difference in degradation value of each pixel through driving of the display panel DP. The generation of corrected image signals CRGB of the correction unit CPP by correcting the image signals RGB using the luminance of the pixel having the reference data RFV in the reference grayscale as the target luminance will be described later with reference to FIGS. 6 to 9.

The data generation unit DGP receives correction image signals CRGB from the correction unit CPP. The data generation unit DGP generates image data IMD based on the correction image signals CRGB and transmits the image data IMD to the source driver SD (see FIG. 3).

The panel controller PCP may further include a temperature measurement unit TMP (e.g., a circuit). The temperature measurement unit TMP may include a temperature sensor and the like, and may measure the temperature of the display panel DP. As an example of the inventive concept, the temperature measurement unit TMP may measure the temperature of the display panel DP by measuring the ambient temperature around the display panel DP. The temperature measurement unit TMP may transmit a temperature signal TMS including temperature information of the display panel DP to the cumulative calculation unit CCP. As an example of the inventive concept, the temperature measurement unit TMP may measure the temperature corresponding to each of a plurality of areas after dividing the display panel DP into the plurality of areas. As an example of the inventive concept, a temperature measurement unit TMP may measure the outside air temperature at any one point of the display panel DP and the outside air temperature at another point spaced apart from the point in the first direction DR1 or the second direction DR2. The cumulative calculation unit CCP may calculate the temperature of the pixels PX based on the temperature signal TMS. The cumulative calculation unit CCP may generate degradation data DGD based on the previously accumulated correction image signals and the calculated temperatures of pixels. In an embodiment, the degradation data DGD indicates how degraded each of the pixels PX are. If a given pixel is in a high temperature region for more than a certain period of time, a degradation value for the given pixel based on the accumulated correction image signals could be increased by a predetermined amount to update the degradation data DGD. As an example of the inventive concept, the correction unit CPP includes a reference value generation unit RVCP, a correction value generation unit CGP, and a correction signal generation unit CSG.

The reference value generation unit RVCP may receive degradation data DGD from the cumulative calculation unit CCP and extract reference data RFV from the degradation data DGD. As an example of the inventive concept, the reference data RFV may be the smallest degradation value among the degradation values included in the degradation data DGD. However, the inventive concept is not limited thereto. The reference data RFV may be extracted as a degradation value having a value of the lower 10% among the degradation values included in the degradation data DGD or a degradation value having a median value among the degradation values included in the degradation data DGD. As an example of the inventive concept, when the reference data RFV is extracted as a degradation value having the lower 10% of the degradation values, compared to the smallest degradation value with the case of extracting the reference data RFV, it is possible to reduce the influence of noise components included in degradation data DGD. In an embodiment, the degradation values include a degradation value for each of the pixels PX that indicates how degraded the corresponding pixel is relative to a non-degraded pixel. For example, the non-degraded pixel might have a degradation value of 0 (0%), a slightly degraded pixel could have degradation value of 0.1 (10%), a very degraded pixel could have a degradation value of 0.4 (40%), etc. For example, if there are 100 degradation values, the lowest degradation value among the 100 is 0 and the tenth lowest degradation value among the 100 is 0.1, then the reference data RFV could be extracted as 0.1.

The correction value generation unit CGP receives degradation data DGD from the cumulative calculation unit CCP, and receives reference data RFV from the reference value generation unit RCVP. The image signals RGB received from the outside by the panel controller PCP may be provided to a correction value generation unit CGP. The correction value generation unit CGP generates a correction value CRV based on reference data RFV, degradation data DGD, and image signals RGB.

A correction signal generation unit CSG receives a correction value CRV from a correction value generation unit CGP, and receives image signals RGB from the outside. A correction signal generation unit CSG generates correction image signals CRGB by correcting image signals RGB based on a correction value CRV. As an example of the inventive concept, the correction image signals CRGB may be signals obtained by adding the correction value CRV to the image signals RGB. As an example of the inventive concept, the grayscale of the data signal DS generated based on the correction image signals CRGB may be larger than the grayscale of the data signal generated based on the image signals RGB.

Figure 6:
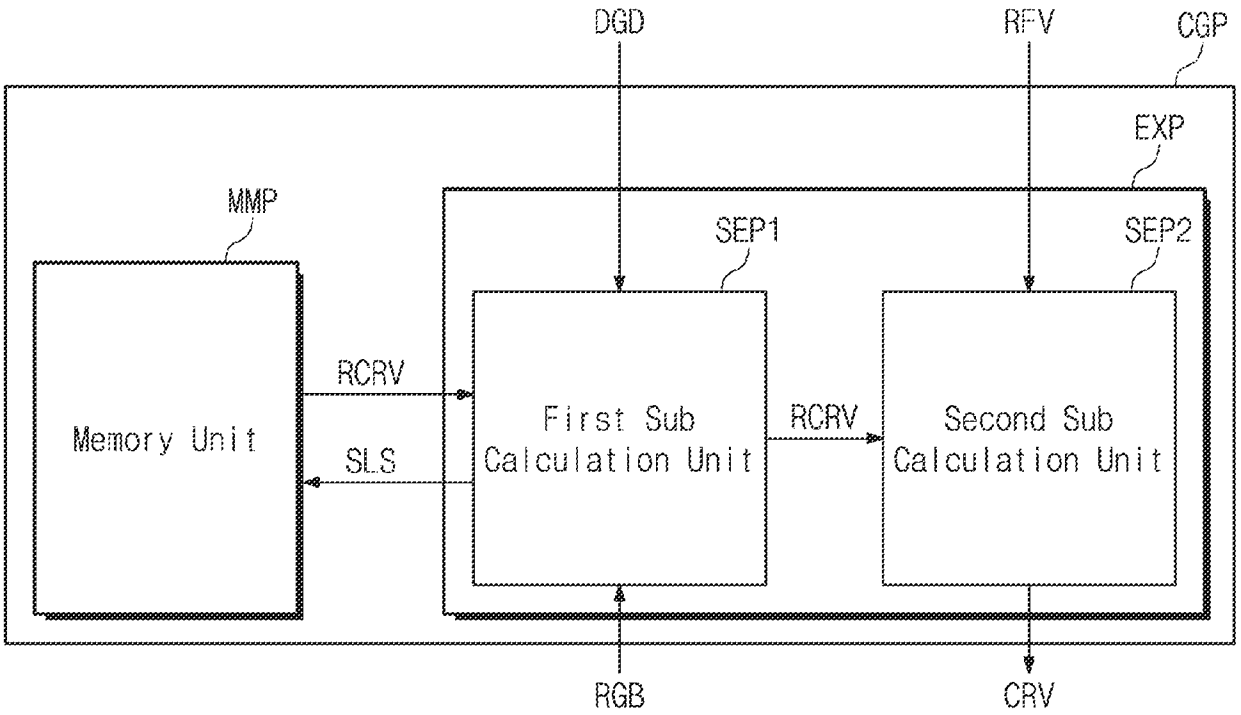
FIG. 6 is a block diagram for explaining the structure of a correction value generation unit according to an embodiment of the inventive concept.
Figure 7:
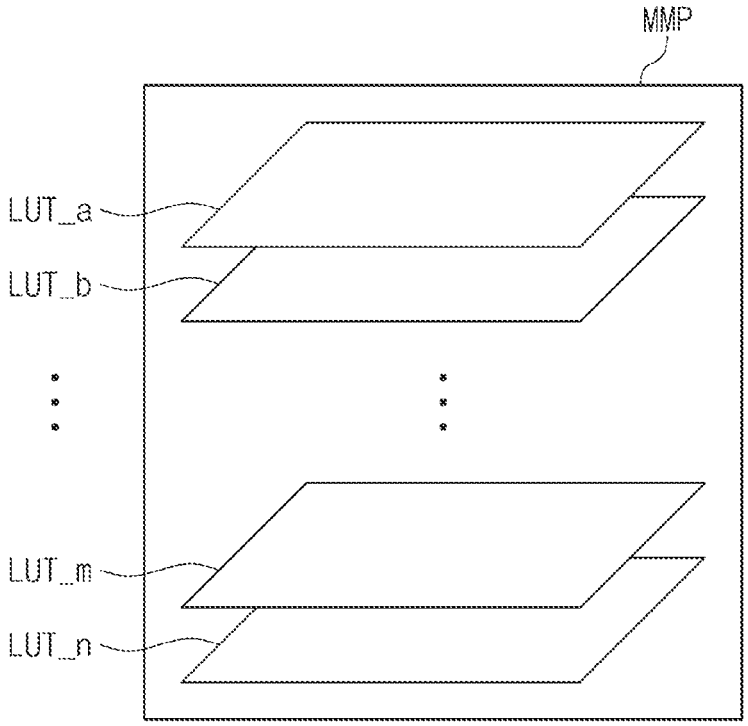
FIG. 7 is a block diagram illustrating a memory unit according to an embodiment of the inventive concept.
Figure 8A:
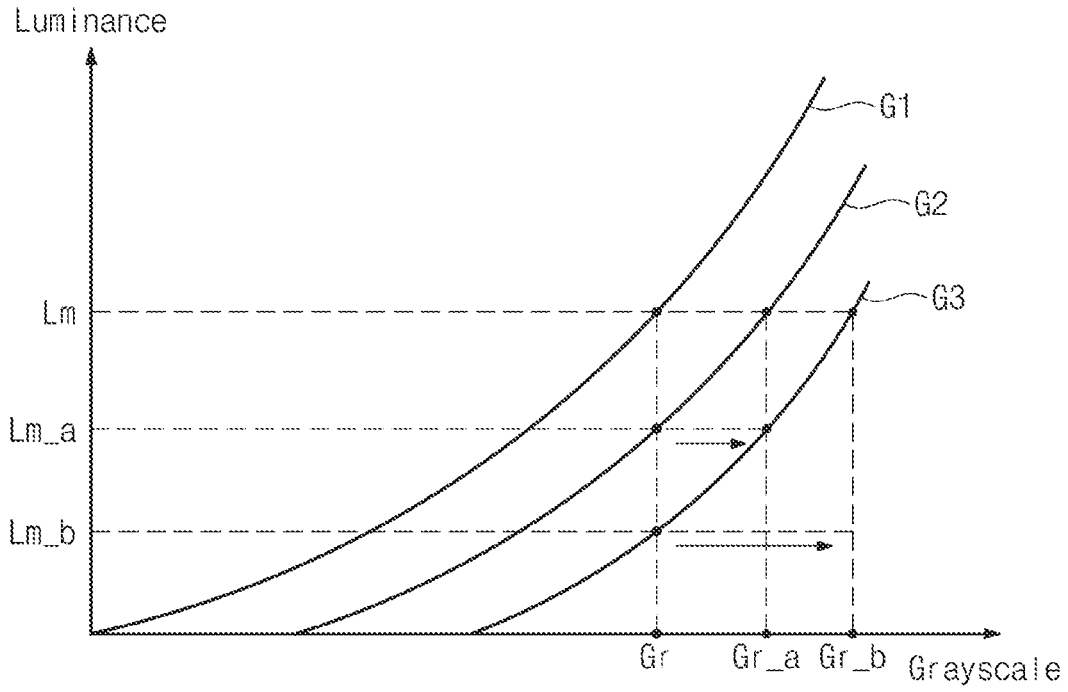
FIGS. 8A to 9 are graphs for explaining the operation of a correction value generation unit according to an embodiment of the inventive concept.
Figure 8B:
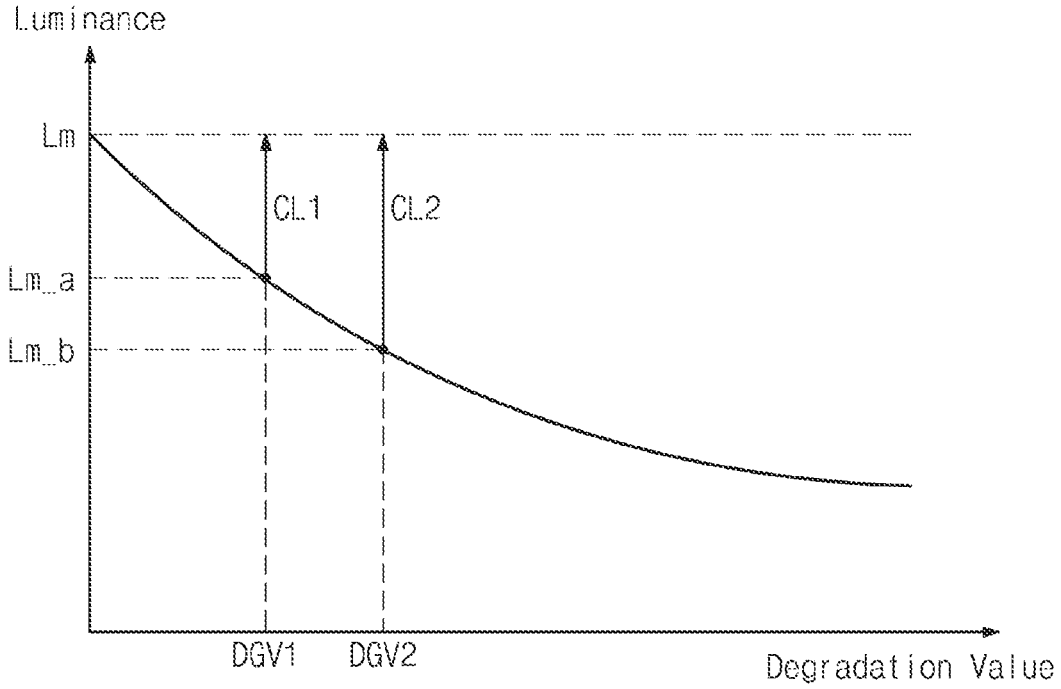
Figure 9:
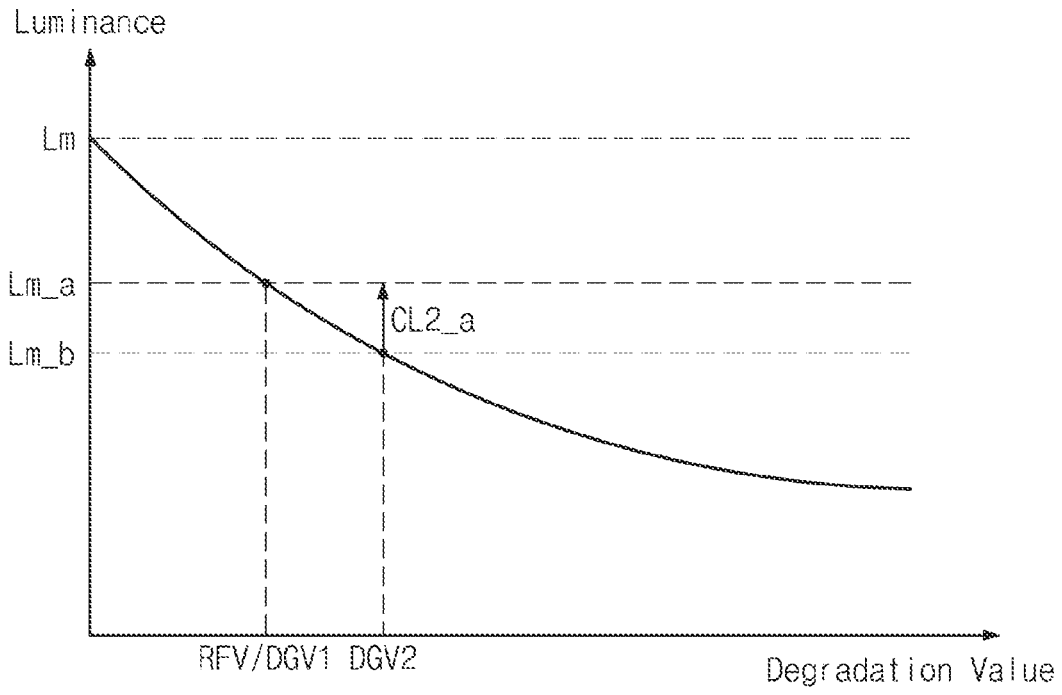

FIG. 6 is a block diagram for explaining the structure of a correction value generation unit of FIG. 5 according to an embodiment of the inventive concept. FIG. 7 is a block diagram illustrating a memory unit according to an embodiment of the inventive concept. FIGS. 8A to 9 are graphs for explaining the operation of a correction value generation unit of according to an embodiment of the inventive concept. Hereinafter, for convenience of description, an embodiment in which a reference grayscale data signal DS is applied to each pixel will be described in FIGS. 8B and 9.

Referring to FIGS. 5, 6 and 7, the correction value generation unit CGP includes a memory unit MMP (e.g., a memory device) and an extraction unit EXP (e.g., a circuit).

The memory unit MMP may include a plurality of lookup tables LUT_a to LUT_n (see FIG. 7). A reference correction value RCRV set to correct the image signals RGB so that the pixels PX (refer to FIG. 3) have a preset reference luminance is stored in each of the plurality of lookup tables LUT_a to LUT_n. As an example of the inventive concept, the memory unit MMP may be a non-volatile memory such as an electrically EPROM (EEPROM) or a flash memory. Accordingly, even if power supplied from the outside to the display device DD is stopped, the reference correction values RCRV stored in the lookup tables LUT_a to LUT_n may be preserved. As an example of the inventive concept, each of the plurality of lookup tables LUT_a to LUT_n may store a reference correction value RCRV having a different size according to the degradation value of the pixels PX (refer to FIG. 3).

The extraction unit EXP receives degradation data DGD from the cumulative calculation unit CCP, and receives reference data RFV from the reference value generation unit RVCP. The extraction unit EXP receives image signals RGB from the outside. The extraction unit EXP reads a reference correction value RCRV from the memory unit MMP based on image signals RGB and degradation data DGD. The extraction unit EXP converts a reference correction value RCRV to correspond to a target luminance that is changed based on the reference data RFV so as to generate a correction value CRV.

Referring to FIGS. 6, 8A, and 8B, the extraction unit EXP includes a first sub extraction unit SEP1 (e.g., a circuit). The first sub extraction unit SEP1 receives image signals RGB from the outside, and receives degradation data DGD from a cumulative calculation unit CCP. The first sub extraction unit SEP1 selects one lookup table corresponding to the degradation value included in the degradation data DGD from among the lookup tables LUT_a to LUT_n, and reads the reference correction value RCRV corresponding to the grayscale of the image signals RGB from the selected lookup table. As an example of the inventive concept, the first sub extraction unit SEP1 may transmit a selection signal SLS for selecting a lookup table corresponding to a degradation value of degradation data DGD to the memory unit MMP. As an example of the inventive concept, the selection signal SLS may include a signal for selecting a reference correction value RCRV corresponding to the grayscale of the image signals RGB from the selected lookup table. However, the inventive concept is not limited thereto, and the first sub extraction unit SEP1 may read the reference correction value RCRV from the memory unit MMP without transmitting the selection signal SLS.

FIG. 8A is a graph showing the grayscale of the data signal DS (refer to FIG. 3) and the luminance of the pixel according to the deterioration of the pixel. The x-axis of FIG. 8A represents the grayscale of the data signal DS, and the y-axis represents the luminance of a pixel according to the data signal DS. In an embodiment, the grayscale is proportional to a voltage of the data signal DS. For example, a first voltage of a first data signal having a first grayscale applied to a first pixel is less than a second voltage of a second data signal applied to a second pixel when the second grayscale is higher than the first grayscale. The first graph G1 is a graph illustrating the relationship between grayscale and luminance of the data signal DS when the pixel is not deteriorated. The second graph G2 is a graph illustrating the relationship between grayscale and luminance of the data signal DS when the pixel has the first degradation value DGV1 (see FIG. 8B). The third graph G3 is a graph illustrating the relationship between grayscale and luminance of the data signal DS when the pixel has a second degradation value DGV2 (see FIG. 8B) greater than the first degradation value DGV1.

Referring to the first to third graphs G1, G2, and G3, it may be seen that even when the data signal DS having the same grayscale is applied, the luminance of the pixel decreases as the degree of deterioration of the pixel increases. Accordingly, when the data signal DS having the first grayscale Gr is applied, the undegraded initial pixel has the first luminance Lm, but the first pixel having the first degradation value DGV1 has the second luminance Lm_a smaller than the first luminance Lm. When the data signal DS having the first grayscale Gr is applied, the first pixel has the second luminance Lm_a, but the second pixel having the second degradation value DGV2 has a third luminance Lm_b smaller than the second luminance Lm_a. Hereinafter, for convenience of description, the first luminance Lm is defined as a first reference luminance Lm. In an embodiment, the intended grayscale of a pixel is increased based on its associated degradation value. For example, the intended grayscale of a pixel during a future frame period could be increased more when this degradation value increases.

Referring to the first to third graphs G1, G2, and G3, even after the pixel is degraded, in order to have the same luminance as before the degradation, as the degree of deterioration of the pixel increases, the data signal DS having a higher grayscale is applied. As an example of the inventive concept, in order for the initial pixel to have the first reference luminance Lm, the data signal DS having the first grayscale Gr is applied to the initial pixel. However, the data signal DS having the second grayscale Gr_a higher than the first grayscale Gr is applied to the first pixel. A data signal DS having a third grayscale Gr_b higher than the second grayscale Gr_a is applied to the second pixel.

FIG. 8B is a graph showing the relationship between the degradation value of the pixel and the luminance of the pixel when the same grayscale data signal DS is applied. The x-axis of FIG. 8B is a degradation value indicating the degree of deterioration of the pixel, and the y-axis is the luminance of the pixel. Referring to FIG. 8B, when the same grayscale data signal DS is applied, as the degradation value of the pixel increases, the luminance of the pixel decreases. As an example of the inventive concept, when a pixel has a first degradation value DGV1, the first reference luminance Lm and the second luminance Lm_a have a first luminance difference CL1. When the pixel has the second degradation value DGV2, the first reference luminance Lm and the third luminance Lm_b have a second luminance difference CL2 greater than the first luminance difference CL1.

Referring to FIGS. 6 and 8B, the reference correction values RCRV stored in the lookup tables LUT_a to LUT_n are values set to correct the image signals RGB to have the first reference luminance Lm as taking the first reference luminance Lm when the pixel is not deteriorated as the target luminance. Therefore, when the pixel has the first degradation value DGV1, the reference correction value RCRV may be a value for correcting the image signals RGB by the first luminance difference CL1. When the pixel has the second degradation value DGV2, the reference correction value RCRV may be a value that corrects the image signals RGB by the second luminance difference CL2. As an example of the inventive concept, the first reference luminance Lm may be a preset luminance.

Referring to FIGS. 6 and 9, the extraction unit EXP includes a second sub extraction unit SEP2 (e.g., a circuit). The second sub extraction unit SEP2 receives the reference correction value RCRV from the first sub extraction unit SEP1 and receives the reference data RFV from the reference value generation unit RVCP. The second sub extraction unit SEP2 converts a reference correction value RCRV to have a target luminance that is changed based on the reference data RFV so as to generate a correction value CRV.

FIG. 9 is a graph illustrating a relationship between a degradation value of a pixel and a luminance of a pixel when a reference grayscale data signal DS is applied. Hereinafter, the same reference numerals are assigned to the data described with reference to FIGS. 8A and 8B, and redundant descriptions thereof will be omitted.

As an example of the inventive concept, the second sub extraction unit SEP2 may obtain the luminance of the pixel having the reference data RFV. As an example of the inventive concept, when the reference data RFV has a first degradation value DGV1, a pixel having the reference data RFV may have a second luminance Lm_a. The second sub extraction unit SEP2 may set the second luminance Lm_a as the target luminance. Accordingly, the correction value CRV generated by converting the reference correction value RCRV through the second sub extraction unit SEP2 is a value set to correct the image signals RGB so that the pixels PX (refer to FIG. 3) have the second luminance Lm_a, by using the second luminance Lm_a as the target luminance. Since the pixel having the first degradation value DGV1 already has the second luminance Lm_a, the image signal corresponding to the pixels having the first degradation value DGV1 might not be corrected by the correction value CRV. The pixel having the second degradation value DGV2 has the third luminance Lm_b in the reference grayscale. The second luminance Lm_a and the third luminance Lm_b have a third luminance difference CL2_*a*. The correction value CRV may be a value for correcting the image signal corresponding to the pixel having the second degradation value DGV2 so that the pixel having the second degradation value DGV2 has the second luminance Lm_a in the reference grayscale.

Referring to FIGS. 8B and 9, the pixel having the second degradation value DGV2 has a third luminance difference CL2_*a* corrected through the correction value CRV smaller than the second luminance difference CL2 corrected through the reference correction value RCRV.

Since the reference correction value RCRV is a value set by using the first reference luminance Lm of the undegraded initial pixel as the target luminance, as the deterioration of the pixels PX progresses, the amount of correction of the image signals RGB through the reference correction value RCRV increases. Therefore, an amount of correcting an image signal corresponding to a pixel that undergoes a lot of deterioration among the image signals RGB through a reference correction value RCRV may be large enough to cause an error in the correction process. Accordingly, due to errors generated in the process of correcting image signals, display quality deterioration such as image sticking may occur.

However, since the correction value CRV is a value set by using the second luminance Lm_a of the pixel having the reference data RFV extracted from the degradation data DGD as the target luminance, even though the deterioration of the pixels PX is high, as the process progresses, the target luminance is also reduced. Accordingly, it is possible to prevent an excessively large amount of correcting of an image signal corresponding to a pixel in which deterioration is advanced among the image signals RGB through the correction value CRV. Therefore, it is possible to prevent errors that may occur in the process of correcting the image signal, thereby preventing display quality deterioration such as image sticking.

Figure 10:
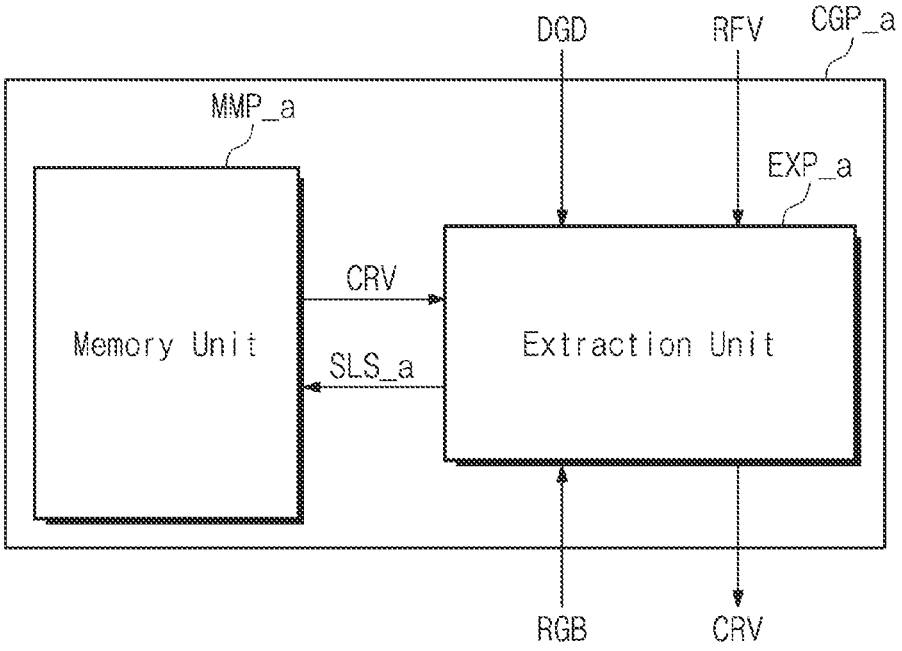
FIG. 10 is a block diagram for explaining the structure of a correction value generation unit according to an embodiment of the inventive concept.
Figure 11:
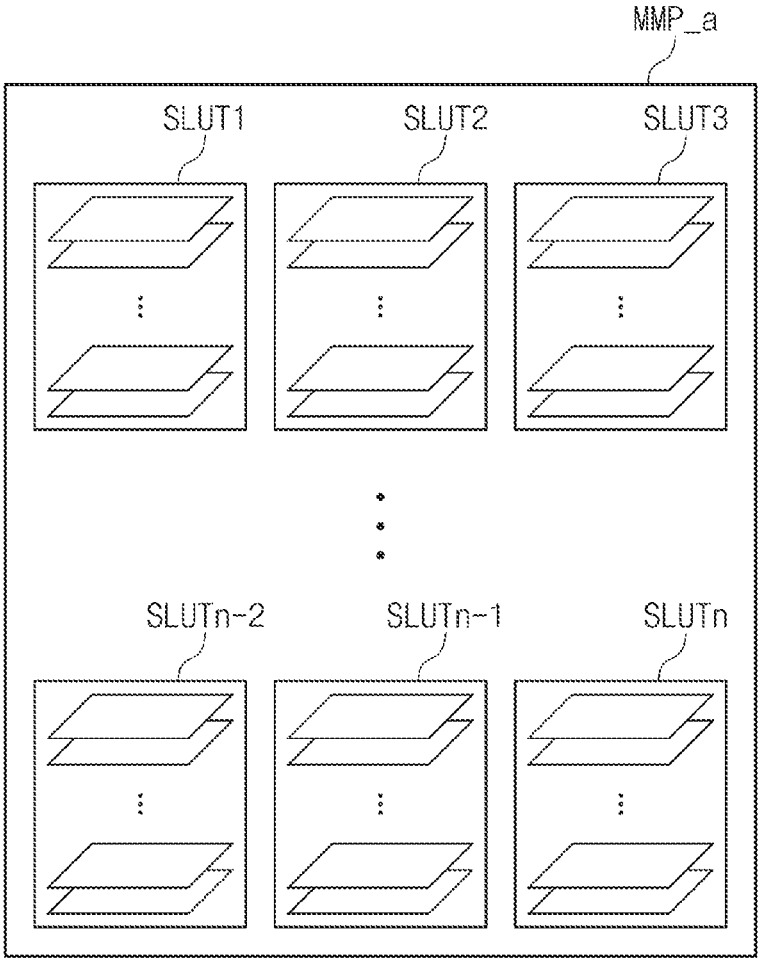
FIG. 11 is a block diagram illustrating a memory unit according to an embodiment of the inventive concept.
Figure 12A:
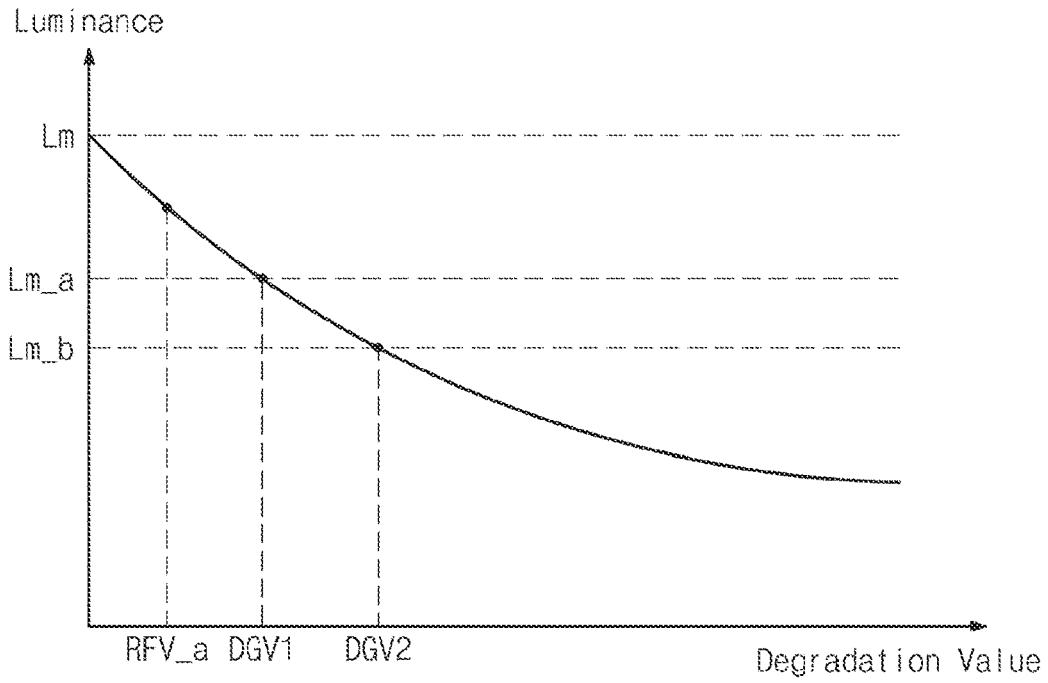
FIGS. 12A to 12C are graphs for explaining an operation of a panel controller according to an embodiment of the inventive concept.
Figure 12B:
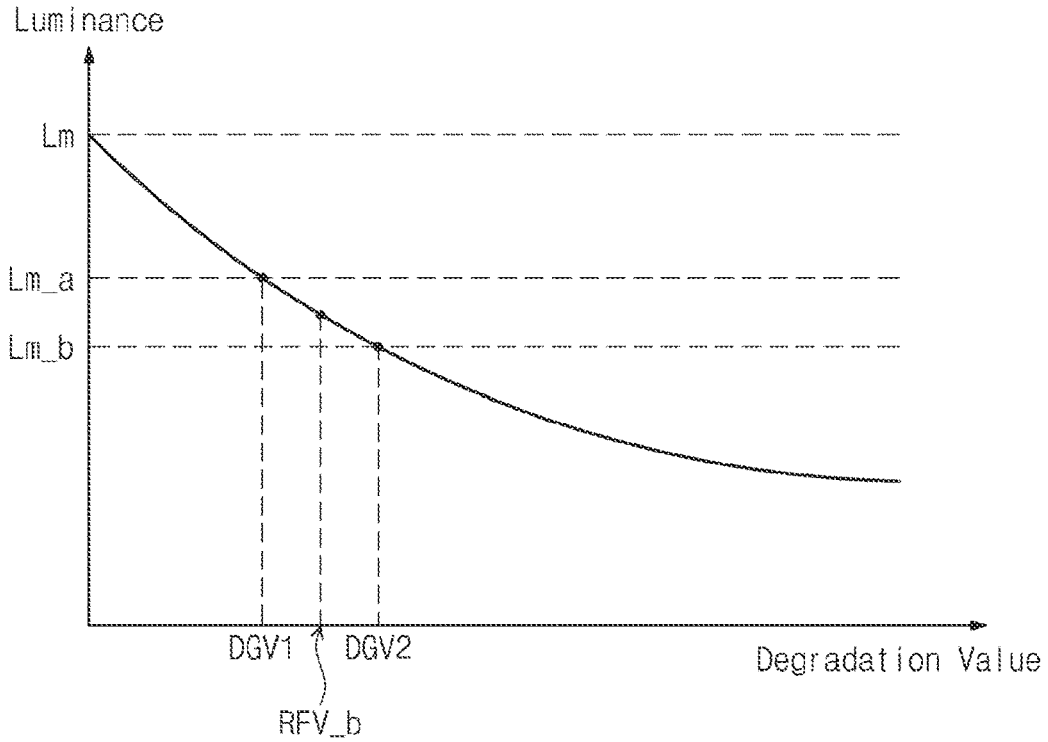
Figure 12C:
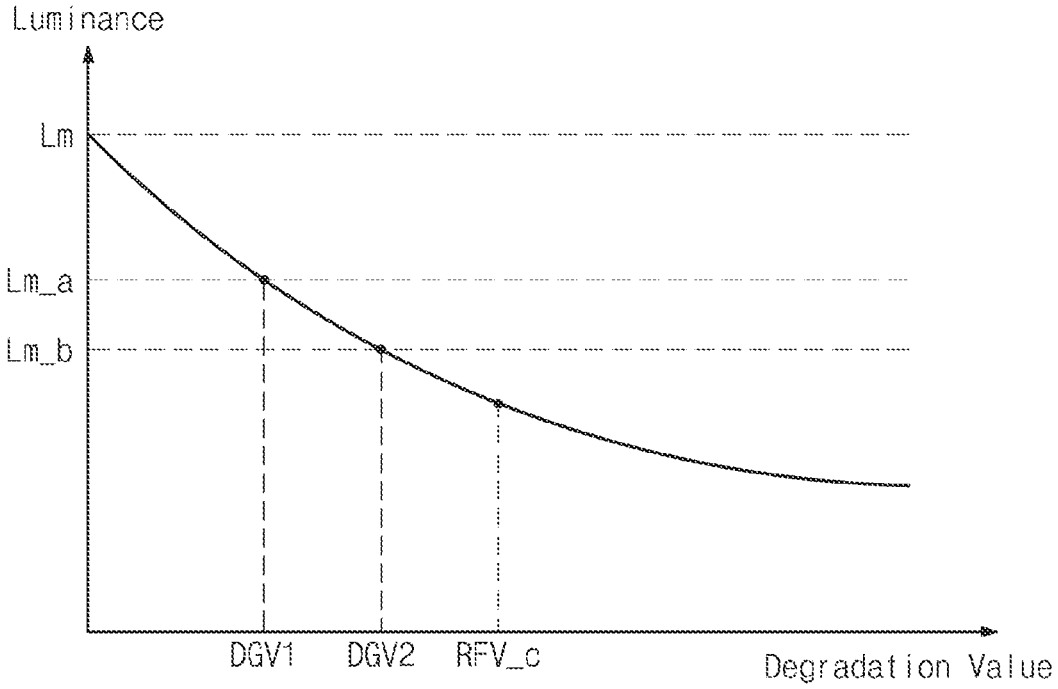

FIG. 10 is a block diagram for explaining the structure of a correction value generation unit of FIG. 5 according to an embodiment of the inventive concept. FIG. 11 is a block diagram illustrating a memory unit according to an embodiment of the inventive concept. FIGS. 12A to 12C are graphs for explaining an operation of a panel controller according to an embodiment of the inventive concept. Hereinafter, the same reference numerals will be given to the same components and signals as those described with reference to FIGS. 6 to 9, and redundant descriptions will be omitted. Also, for convenience of description, an embodiment in which a data signal DS of a reference grayscale is applied to each pixel will be described in FIGS. 12A to 12C.

Referring to FIGS. 10 to 12B, the correction value generation unit CGP_a includes a memory unit MMP_a and an extraction unit EXP_a. Hereinafter, for convenience of description, the second luminance Lm_a is defined as the second reference luminance Lm_a, and the third luminance Lm_b is defined as the third reference luminance Lm_b.

The memory unit MMP_a includes a plurality of lookup tables SLUT1 to SLUTn. Each of the lookup tables stores preset correction values CRV with different luminances as target luminances. As an example of the inventive concept, the correction value CRV includes a first correction value, a second correction value, and a third correction value. As an example of the inventive concept, a first correction value set based on the first reference luminance Lm is stored in the first lookup table SLUT1. A second correction value set based on the second reference luminance Lm_a is stored in the second lookup table SLUT2. A third correction value set based on the third reference luminance Lm_b is stored in the third lookup table SLUT3. As an example of the inventive concept, the first to third reference luminances Lm, Lm_a, and Lm_b may be preset luminances.

The extraction unit EXP_a selects a corresponding lookup table from among the lookup tables SLUT1 to SLUTn according to the degradation value of the reference data RFV.

FIGS. 12A to 12C are graphs showing the relationship between the degradation value of the pixel and the luminance of the pixel. As an example of the inventive concept, the first reference luminance Lm corresponds to the luminance of the pixel when the pixel is not degraded, that is, when the degradation value is 0. The second reference luminance Lm_a corresponds to the luminance of the pixel having the first degradation value DGV1. The third reference luminance Lm_b corresponds to the luminance of the pixel having the second degradation value DGV2.

Referring to FIGS. 10 and 12A, when the degradation value of the reference data RFV_a is less than or equal to the first degradation value DGV1, the extraction unit EXP_a selects the first lookup table SLUT1 from among the lookup tables SLUT1 to SLUTn. The extraction unit EXP_a extracts the first correction value stored in the first lookup table SLUT1 selected based on degradation data DGD and image signals RGB.

Referring to FIGS. 10 and 12B, when the degradation value of the reference data RFV_b is greater than the first degradation value DGV1 and less than or equal to the second degradation value DGV2, the extraction unit EXP_a selects the second lookup table SLUT2 from among the lookup tables SLUT1 to SLUTn. The extraction unit EXP_a extracts a second correction value included in the second lookup table SLUT2 selected based on degradation data DGD and image signals RGB.

Referring to FIGS. 10 and 12C, when the degradation value of the reference data RFV_c is greater than the second degradation value DGV2, the extraction unit EXP_a selects the third lookup table SLUT3 from among the lookup tables SLUT1 to SLUTn. The extraction unit EXP_a extracts a third correction value included in the third lookup table SLUT3 selected based on degradation data DGD and image signals RGB. The inventive concept is not limited thereto, and after selecting the corresponding lookup table according to the size of the degradation value of the reference data RFV from among the lookup tables SLUT1 to SLUTn, the extraction unit EXP_a may extract a correction value CRV from a lookup table selected based on degradation data DGD and image signals RGB. As an example of the inventive concept, the extraction unit EXP_a may transmit a selection signal SLS_a for selecting a lookup table corresponding to a degradation value of degradation data DGD to the memory unit MMP_a. As an example of the inventive concept, the selection signal SLS_a may include a signal for selecting a correction value CRV corresponding to the grayscale of the image signals RGB from the selected lookup table. However, the inventive concept is not limited thereto, and the extraction unit EXP_a may read the correction value CRV from the memory unit MMP_a without transmitting the selection signal SLS_a.

As an example of the inventive concept, the sizes of the first degradation value DGV1 and the second degradation value DGV2 may be variously set. Therefore, in an example where the degradation value is 0, the interval between the first degradation value DGV1, and the interval between the first degradation value DGV1 and the second degradation value DGV2 may be variously set. Through this, a compensation error occurring when the image signals RGB are corrected to have the first reference luminance Lm due to the deterioration of the pixel may be prevented. Also, compared to an example where the image signals RGB are corrected by using the luminance of the pixel having the reference data RFV as the target luminance, it is possible to minimize the decrease in luminance due to deterioration of the pixel.

According to at least one embodiment of the inventive concept, it is possible to correct the grayscale of the image displayed on the display panel in response to the degree of deterioration of the display panel. Therefore, it is possible to compensate for the deterioration of the image displayed on the display panel due to the deterioration of the display panel. Also, it is possible to prevent the quality of the image displayed on the display panel from being deteriorated due to the correction error of the image grayscale.

Although various embodiments of the inventive concept have been described, it is understood that the inventive concept should not be limited to these embodiments but various changes and modifications may be made by one ordinary skilled in the art within the spirit and scope of the inventive concept as hereinafter claimed.

What is claimed is:

1. A display device comprising:

a display panel including a plurality of pixels to display an image; and a panel control circuit wherein the panel control circuit comprises:

a correction circuit configured to receive image signals of a current frame period to generate correction image signals of the current frame period; and a cumulative calculation circuit configured to accumulate the correction images signals of the current frame period and generate degradation data based on accumulated correction image signals generated by accumulating previous correction image signals of a prior frame period to the cumulative calculation circuit, wherein the correction circuit is configured to determine reference data from the degradation data and generate the correction image signals of the current frame period by correcting the image signals of the current frame period by correcting the image signals of the current frame period to have a target luminance that is changed based on the reference data, and wherein the panel control circuit generates image data of the current frame period for application to the pixels based on the correction image signals of the current frame period.

2. The display device of claim 1, wherein the target luminance is a luminance of a pixel of the display panel having the reference data among the pixels at a reference grayscale.

3. The display device of claim 1, wherein the degradation data comprises a plurality of degradation values indicating a degree of degradation of each of the pixels, wherein the reference data has a smallest degradation value among the degradation values.

4. The display device of claim 3, wherein the correction circuit comprises:

a reference value generation circuit configured to receive the degradation data from the cumulative calculation circuit and determine the reference data based on the degradation data;

a correction value generation circuit configured to generate a correction value based on the reference data, the image signals of the current frame period, and the degradation data; and a correction signal generation circuit configured to generate the correction image signals of the current frame period by correcting the image signals based on the correction value.

5. The display device of claim 4, wherein the correction value generation circuit comprises:

a memory device including a lookup table; and an extraction circuit configured to read a reference correction value stored in the lookup table based on the image signals of the current frame period and the degradation data, and convert the reference correction value to correspond to the target luminance to generate the correction value.

6. The display device of claim 5, wherein the reference correction value is a value set to correct the image signals of the current frame period with a reference luminance, wherein the correction value is a value set to correct the image signals of the current frame period to have the target luminance.

7. The display device of claim 5, wherein the extraction circuit comprises:

a first sub extraction circuit configured to read the reference correction value stored in the lookup table based on the image signals of the current frame period and the degradation data; and a second sub extraction circuit configured to receive the reference correction value from the first sub extraction circuit, receive the reference data from the reference value generation circuit, and convert the reference correction value to correspond to the target luminance to generate the correction value.

8. The display device of claim 7, wherein the correction signal generation circuit receives the correction value from the second sub extraction circuit and corrects the image signals of the current frame period based on the correction value to generate the correction image signals.

9. The display device of claim 4, wherein the correction value generation circuit comprises:

a memory device including a plurality of lookup tables; and an extraction circuit configured to select one of the plurality of lookup tables based on the reference data and extract a correction value stored in the selected lookup table based on the image signals of the current frame period and the degradation data.

10. The display device of claim 9, wherein the lookup tables comprise a first lookup table and a second lookup table, wherein the correction value comprises a first correction value and a second correction value, wherein the extraction circuit, when the degradation value of the reference data is less than or equal to a first degradation value, extracts the first correction value from the first lookup table, and when the degradation value of the reference data is greater than the first degradation value, extracts the second correction value from the second lookup table.

11. The display device of claim 10, wherein the first lookup table is a lookup table in which the first correction value set based on a first reference luminance is stored, wherein the second lookup table is a lookup table in which the second correction value set based on a preset second reference luminance is stored, wherein the second reference luminance corresponds to the luminance of the pixel having the first degradation value among the pixels in the reference grayscale, wherein the first reference luminance is greater than the second reference luminance.

12. The display device of claim 11, wherein the correction value further comprises a third correction value, wherein the lookup tables further comprise a third lookup table, wherein the extraction circuit, when the degradation value of the reference data is greater than the first degradation value and less than or equal to a second degradation value, extracts the second correction value from the second lookup table, and when the degradation value of the reference data is greater than the second degradation value, extracts the third correction value from the third lookup table, wherein the second degradation value is greater than the first degradation value.

13. The display device of claim 12, wherein the third lookup table is a lookup table in which the third correction value set based on a third reference luminance is stored, wherein the third reference luminance corresponds to the luminance of the pixel having the second degradation value among the pixels in the reference grayscale, wherein the second reference luminance is greater than the third reference luminance.

14. The display device of claim 1, wherein the panel control circuit further comprises a data generation circuit that generates the image data based on the correction image signals.

15. The display device of claim 1, wherein the panel control circuit further comprises a temperature sensing circuit that measures a temperature of the display panel, wherein the cumulative calculation circuit receives a temperature signal including information on the temperature from the temperature sensing circuit, and generates the degradation data based on the accumulated correction image signals and the temperature signal.

16. A display device comprising:

a display panel including a plurality of pixels to display an image; and a panel control circuit wherein the panel control circuit comprises:

a cumulative calculation circuit configured to accumulate the correction image signals of a current frame period and generate degradation data including a plurality of degradation values indicating a degree of degradation of each of the pixels based on accumulated correction image signals generated by accumulating correction image signals of a prior fame period to the cumulative calculation circuit; and a correction circuit configured to determine reference data from the degradation data, and configured to, if the degradation value included in the reference data is less than or equal to a reference value, generate the correction image signals of the current frame period by correcting the image signals of the current frame period to have a first reference luminance, and if the degradation value is greater than the reference value, generate the correction image signals of the current frame period by correcting the image signals of the current frame period to have a second reference luminance, wherein the first reference luminance is greater than the second reference luminance, and wherein the panel control circuit generates image data of the current frame period for application to the pixels based on the correction image signals of the current frame period.

17. The display device of claim 16, wherein the reference data has a smallest degradation value among the degradation values.

18. The display device of claim 16, wherein the correction circuit comprises:

a reference value generation circuit configured to receive the degradation data from the cumulative calculation circuit and determine the reference data based on the degradation data;

a correction value generation circuit configured to generate a correction value based on the reference data, the image signals of the current frame period, and the degradation data; and a correction signal generation circuit configured to generate the correction image signals by correcting the image signals of the current frame period based on the correction value.

19. The display device of claim 18, wherein the correction value generation circuit comprises:

a memory device including a plurality of lookup tables; and an extraction circuit configured to select one of the plurality of lookup tables based on the reference data and extract a correction value stored in the selected lookup table based on the image signals of the frame period and the degradation data.

20. The display device of claim 19, wherein the lookup tables comprise a first lookup table and a second lookup table, wherein the correction value comprises a first correction value and a second correction value, wherein the extraction circuit, when the degradation value of the reference data is less than or equal to the reference value, extracts the first correction value from the first lookup table, and when the degradation value of the reference data is greater than the reference value, extracts the second correction value from the second lookup table, wherein the first lookup table is a lookup table in which the first correction value set based on the first reference luminance is stored, wherein the second lookup table is a lookup table in which the second correction value set based on the second reference luminance is stored.

* * * * *